US009729961B2

(12) United States Patent
Howard et al.

(10) Patent No.: US 9,729,961 B2
(45) Date of Patent: Aug. 8, 2017

(54) ACTIVELY SUSPENDED SEAT WITH BASS LOUDSPEAKERS

(71) Applicant: Bose Corporation, Framingham, MA (US)

(72) Inventors: Damian Howard, Winchester, MA (US); Bradford Kyle Subat, Northborough, MA (US)

(73) Assignee: Bose Corporation, Framingham, MA (US)

( * ) Notice: Subject to any disclaimer, the term of this patent is extended or adjusted under 35 U.S.C. 154(b) by 14 days.

(21) Appl. No.: 14/952,889

(22) Filed: Nov. 25, 2015

(65) Prior Publication Data

US 2016/0150313 A1 May 26, 2016

Related U.S. Application Data

(60) Provisional application No. 62/084,272, filed on Nov. 25, 2014.

(51) Int. Cl.

| | |
|---|---|
| ***H04R 1/28*** | (2006.01) |
| ***H04R 1/02*** | (2006.01) |
| ***H04R 29/00*** | (2006.01) |
| ***H04R 3/04*** | (2006.01) |
| ***H04R 5/02*** | (2006.01) |

(52) U.S. Cl.

CPC ..... *H04R 1/2803* (2013.01); *H04R 1/025* (2013.01); *H04R 1/28* (2013.01); *H04R 29/001* (2013.01); *H04R 3/04* (2013.01); *H04R 5/023* (2013.01); *H04R 2499/13* (2013.01)

(58) Field of Classification Search

CPC ..... B60N 2/501; B60N 2/502; B60N 2/503; B60N 2/504; H04R 1/2803; H04R 1/025; H04R 1/28; H04R 5/023; H04R 2499/13; H04R 29/001; H04R 3/04

USPC ..... 381/71.4, 86; 701/36, 45, 49, 53

See application file for complete search history.

(56) References Cited

U.S. PATENT DOCUMENTS

| | | | | |
|---|---|---|---|---|
| 5,617,315 | A * | 4/1997 | Nakao | G10K 11/1786 381/71.11 |
| 8,095,268 | B2 | 1/2012 | Parison et al. | |
| 8,194,873 | B2 | 6/2012 | Pan et al. | |
| 8,280,073 | B2 * | 10/2012 | Ganeshkumar | G10K 11/1786 381/71.11 |
| 8,725,351 | B1 | 5/2014 | Selden et al. | |
| 2005/0100173 | A1 * | 5/2005 | Eid | H04R 3/04 381/86 |
| 2007/0058824 | A1 * | 3/2007 | Aylward | H04R 1/028 381/152 |
| 2010/0204881 | A1 * | 8/2010 | Muragishi | F16F 7/1005 701/36 |

* cited by examiner

*Primary Examiner* — David Ton

(74) *Attorney, Agent, or Firm* — Brian M. Dingman; Dingman IP Law, PC

(57) ABSTRACT

A system for a seat in a motor vehicle that has a cabin audio system and a bass loudspeaker that is able to generate sound in the cabin. The system includes a seat active suspension system with a vibration sensor coupled to the seat, and a controller that is responsive to the vibration sensor and that outputs control signals that are provided to an electromagnetic actuator that reduces seat vibrations. The active suspension system is arranged such that it can cause a change in the audio system.

20 Claims, 4 Drawing Sheets

ACTIVELY SUSPENDED SEAT WITH BASS LOUDSPEAKERS

CROSS-REFERENCE TO RELATED APPLICATION

This application claims priority of Provisional Patent Application 62/084,272, filed on Nov. 25, 2014, the disclosure of which is incorporated herein by reference.

BACKGROUND

This disclosure relates to an actively suspended seat with bass loudspeakers in the seat.

Actively suspended seats can be used in motor vehicles. These seats can decrease or remove vibrations that are transmitted through the seat structure to the driver. Active seat suspension systems are known; examples are disclosed in U.S. Pat. Nos. 8,095,268 and 8,725,351, the disclosures of which are incorporated herein by reference.

Motor vehicle audio systems typically operate in a frequency range of from about 20 Hz to about 20,000 Hz. Such audio systems often include bass loudspeakers. The bass loudspeakers can be used to provide low-end sound. They can also be used as part of an active noise cancellation system, such as an engine harmonic noise cancellation (EHC) system which uses loudspeakers (which are typically but not necessarily the bass loudspeakers that are used by the audio system) to decrease or cancel sound pressure levels in the cabin caused by engine harmonic vibrations. EHC systems are known; examples are disclosed in U.S. Pat. Nos. 8,194,873 and 8,280,073, the disclosures of which are incorporated herein by reference. EHC systems need to radiate sound at the same frequency as the sound to be cancelled, which is commonly in the range of from about 20 Hz to about 200 Hz. For example, for some 6-cylinder motor vehicles that idle at around 600 RPM the third harmonic frequency, which can dominate engine-derived motor vehicle cabin noise and so should be cancelled by an EHC system, is about 30 Hz.

SUMMARY

The bass loudspeaker(s) that are used by the EHC and/or the motor vehicle audio system can be mounted on or in an actively-suspended seat. When they are, they can vibrate the seat. If such vibrations are in the frequency band of the vibration control loop of the active suspension system they can interfere with the operation of the active suspension system. If the seat-mounted speakers are used in an EHC system, they may need to radiate at around 30 Hz; this frequency falls in the control band of an active suspension system. Mounting bass loudspeakers in an actively-suspended seat thus can have a detrimental impact on the active suspension of the seat.

An audio system for a motor vehicle with an actively suspended seat can have some or all of the audio loudspeakers built into the seat. For example, the subwoofers may be carried on or in the seat; in one case the subwoofers may be indirectly coupled to the rigid seat frame. If signals from the bass speakers make their way into the control loop for the active vibration suspension system, they will interfere with the effectiveness of the active suspension. In this disclosure, one or more approaches can be implemented so as to inhibit or prevent vibrations from the bass speakers from making their way into the control loop for the seat active suspension system. One approach to inhibit or prevent vibrations from the bass speakers from making their way into the active seat control loop is to reduce or eliminate any coupling of vibrations from the bass speakers to the seat structure. Another approach is to alter the mechanical path between the speakers and the control loop input sensor such that vibrations at frequencies within the control loop are minimized. A third approach is to separate the operating bandwidth of the bass speakers from the closed loop bandwidth of the seat suspension system controller, so that interference is avoided, where bandwidth separation is defined for purposes of this disclosure as separation of the −3 dB corner frequencies of the respective bands.

All examples and features mentioned below can be combined in any technically possible way.

In one aspect a system for a seat in a motor vehicle that has a cabin audio system and a bass loudspeaker that is able to generate sound in the cabin, includes a seat active suspension system with a vibration sensor coupled to the seat, and a controller that is responsive to the vibration sensor and that outputs control signals that are provided to an electromagnetic actuator that reduces seat vibrations. The active suspension system is arranged such that it can cause a change in the audio system. The system may further include an engine harmonic cancellation system that uses the bass loudspeaker to decrease cabin sound pressure level caused by engine harmonic vibrations. The audio system may be a sound reproduction system.

Embodiments may include one of the following features, or any combination thereof. The change in the audio system caused by the active suspension can take priority over other dynamic changes to the audio system that are part of the audio system function. The system can further comprise an engine harmonic cancellation (EHC) system that uses the bass loudspeaker to decrease cabin sound pressure level caused by engine harmonic vibrations. The EHC system may comprise a high pass filter to control the output bandwidth of the EHC system, wherein a corner frequency of the high pass filter is varied as a function of the operating engine RPM of the motor vehicle. The audio system may comprise a music reproduction system.

Embodiments may include one of the following features, or any combination thereof. The bass loudspeaker may be attached to the seat. The bass loudspeaker may be compliantly attached to the seat. The bass loudspeaker may comprise a pair of bass loudspeaker elements mounted in opposition such that vibrations from the pair of bass loudspeaker elements destructively interfere with each other. The structure of the seat may be stiffened such that resonances of the seat structures occur higher in frequency than an operating bandwidth of the active suspension system. The change caused in the audio system may comprise a reduction in the output level of the audio system; the change caused in the audio system may further comprise a change in the operating bandwidth of audio system.

Embodiments may include one of the following features, or any combination thereof. The change caused in the audio system may comprise a change in an operating bandwidth of audio system. The seat active suspension system may further comprise a saturation detector to detect saturation of the first vibration sensor. The active suspension system may cause a change in the cabin audio system when saturation of the first vibration sensor is detected by the saturation detector. The active suspension system may be caused to operate in a passive mode when saturation of the first vibration sensor by the cabin audio system output is detected by the saturation detector. The active suspension system may be caused to operate using the output of a second vibration sensor that is not saturated, when saturation of the first vibration sensor by the cabin audio system output is detected by the saturation detector. The first vibration sensor may be an accelerometer and the second vibration sensor may be a position sensor. A mechanical filter may be inserted in the structural path between the bass loudspeaker and the first vibration sensor such that vibration from the bass loudspeaker that reaches the first vibration sensor is attenuated.

In another aspect, a system for a seat in a motor vehicle that has a cabin audio system and a bass loudspeaker that is able to generate sound in the cabin includes a seat active suspension system comprising a vibration sensor coupled to the seat and a controller that is responsive to the vibration sensor and that outputs control signals that are provided to an electromagnetic actuator that reduces seat vibrations, wherein the active suspension system has a control loop bandwidth and the audio system has an operating frequency range that is constrained to be above the control loop bandwidth.

In another aspect, a system for a seat in a motor vehicle that has a cabin audio system and a bass loudspeaker that is able to generate sound in the cabin includes a seat active suspension system comprising a vibration sensor coupled to the seat and a controller that is responsive to the vibration sensor and that outputs control signals that are provided to an electromagnetic actuator that reduces seat vibrations, and an adaptive noise canceller. The adaptive noise canceller is arranged to subtract an adaptively filtered version of a signal being reproduced by the audio system from the vibration sensor output, to reduce the component of the vibration sensor output related to the audio system output.

In another aspect, a method of operating an active vibration control system and an audio reproduction system includes determining if an output of the audio system is detected by a vibration sensor associated with the active vibration control system and altering the output of the audio system in response to the determining step.

DETAILED DESCRIPTION

This disclosure may be accomplished with an audio system for an actively suspended seat, with one or more bass loudspeakers mounted in the seat. If signals from the bass speakers make their way into the control loop for the active vibration suspension system, they will interfere with the effectiveness of the active suspension. In this disclosure, one or more approaches can be implemented to inhibit or prevent vibrations from the bass speakers from making their way into the control loop for the seat active suspension system.

One approach is to reduce or eliminate any coupling of vibrations from the bass speakers to the seat structure. One way this can be done is by mounting the bass speakers in a vibration-cancelling orientation and operating them in phase, such that vibrations from the speakers destructively interfere with each other and are cancelled.

Another approach is to alter the mechanical path between the speakers and the control loop input sensor such that vibrations at frequencies within the control loop, or close enough to the control loop band so as to affect the control loop input sensor, are minimized or eliminated. One way in which this can be done is to stiffen the seat structure to the point where its resonances are above the bandwidth of the control loop. Another manner is to insert a mechanical low-pass filter into the seat structure somewhere in the structural path between the bass box and the sensor, where the corner frequency of the mechanical low pass filter is below the operating band of the control loop. One example of this is to use compliant mounts for the bass box, where the compliant mounts and the mass of the bass box provide the low-pass function.

Another approach is to separate the operating bandwidth of the bass speakers from the closed loop bandwidth of the seat suspension system controller, so that interference is avoided.

It is also possible for the acoustic output of the speaker system to cause vibration of the seat that can be sensed by the active suspension system sensor. The acoustic output of the speaker system can pressurize cavities that may be present in the seat structure which can cause the walls of the cavities to vibrate. This vibration can couple into the seat structure and the active seat suspension sensor. One approach for reducing this vibration is to design the seat or alter an existing seat design so as to avoid introducing or to fill in or close off cavities in the seat structure, so there are not cavities present that can be excited by the acoustic output of the speaker system acoustic output at frequencies in the control loop band.

Figure 1:
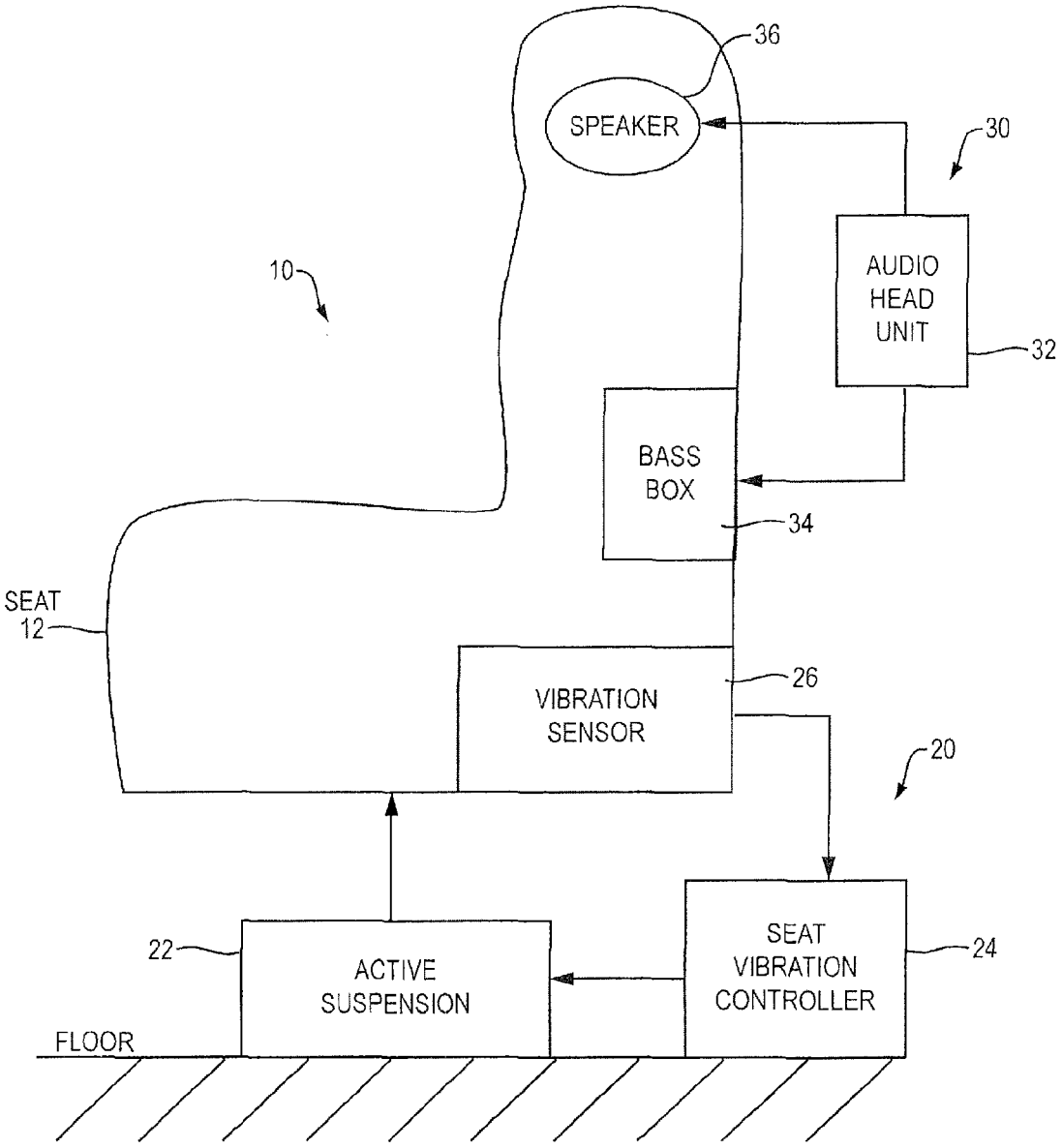
FIG. 1 is a schematic block diagram of a suspended seat with bass loudspeakers.

FIG. 1 is a schematic diagram of suspended seat with bass loudspeakers 10. Seat 12 (which may be but need not be the driver's seat of a motor vehicle) includes active seat suspension (vibration cancelling) system 20. System 20 includes seat active suspension 22 that is operated by controller 24 so as to reduce or eliminate seat vibrations detected by seat vibration sensor 26, which may be but need not be an accelerometer.

The element identified as seat 12 is a sprung mass. The sprung mass can be a seat but alternatively can be any structure or device that is coupled to a moving platform and is actively suspended with a suspension element that is controlled to achieve a particular suspension result. In one non-limiting example, the sprung mass is a device (e.g., a seat) that is part of or carried by a moving platform such as a motor vehicle, train, airplane, boat or other means of conveyance that moves along (or below) the ground, or through the air or in or on the water and in which the device is suspended relative to the moving platform and the suspension system is active rather than purely passive.

Active suspension 22 includes an actuator that is capable of outputting an arbitrary force. One particular non-limiting example of a sprung mass is a seat for the driver of a truck, with an active suspension that in part is designed to cancel or at least minimize the seat vibrations caused by the running engine and by movement of the truck over roadways. In this case, suspension 22 typically comprises an electromagnetic actuator with a linear output, such as a linear actuator. The electromagnetic actuator is capable of producing an arbitrary force on the sprung mass that is largely independent of the position, velocity or acceleration of the sprung mass. In some cases suspension 22 may also include a dynamically adjustable spring that is used as a force bias eliminator to maintain the system at equilibrium such that the electromagnetic motor is used primarily to counteract smaller perturbations. In one non-limiting example this variable spring is a low-stiffness spring. Active suspension systems are further detailed in U.S. Pat. Nos. 8,095,268 and 8,725,351.

Seat vibration controller 24 provides control signals that ultimately cause the electromagnetic actuator present in suspension 22 to exert force on seat 12. There may be a user interface to controller 24 (not shown) which may comprise any means to allow user input so as to control certain aspects of system 20, and more particularly of controller 24. Seat 12 (which together with the driver sitting on the seat is the sprung mass) has vibration sensor 26 (e.g., an accelerometer) coupled to it. System 20 may also include a position sensor (not shown) which measures the position of seat 12 relative to the floor (the floor is the unsprung mass). Vibration is induced in the floor due to both operation of the motor vehicle's engine, and motion of the vehicle over a roadway. These motions can be sensed using a position sensor that measures the relative position of the floor and the seat. Accelerations of the seat are measured by sensor 26. The sensor data from the accelerometer is used to cancel vibrations, and the position sensor data (when present) is used to keep the system in about the middle of its suspension system range.

Controller 24 (which may be implemented in a custom digital signal processor or the like) has a vibration cancelling function that is input with sprung mass acceleration from sensor 26, and used to operate the electromagnetic actuator so as to cancel seat vibrations. When a position sensor is used, a seat centering function of the controller is input with sprung mass position information from the position sensor so as to control a variable force spring (not shown). Other details of active seat suspension systems are disclosed in U.S. Pat. Nos. 8,095,268 and 8,725,351.

Motor vehicle audio system 30 comprises audio head unit 32 that drives mid/high-range speaker 36 (which may or may not be mounted in seat 12), and one or more bass speakers. The bass speakers are preferably in bass box 34. Bass box 34 may be mounted in or on seat 12. There may be more than one bass box. The bass box may not be attached to the seat. Vibrations caused by bass box 34 can cause vibrations in seat 12. If these vibrations are sensed by sensor 26, they will affect the vibration cancelling function of system 20. Also, such vibrations will vibrate the occupant of the seat, which is generally undesirable. However, there may be some cases in which it is desirable to vibrate the seat occupant. Regardless of whether or not it is desirable for the occupant to feel seat vibrations caused by the bass speakers, it is not desirable for such vibrations to be sensed by the accelerometer that is mounted to the seat.

This disclosure involves one or more approaches that can be taken to inhibit or prevent vibrations from seat-mounted bass speaker(s) from making their way into the control loop for the seat active suspension system. One approach is to reduce or eliminate any coupling of vibrations from the bass speakers to the structure of seat 12. One non-limiting manner in which this can be done is by mounting the bass speakers in a vibration-cancelling orientation and operating them such that vibrations from the speakers destructively interfere with each other and are cancelled. Another approach is to construct the mechanical path between the speakers and the control loop input sensor 26, or otherwise insert a mechanical filter into the path, such that vibrations at frequencies within the control loop are minimized. One non-limiting manner in which this can be done is by stiffening the seat structure to the point where its resonances are above the bandwidth of the control loop. Another approach is to separate the operating bandwidth of the bass speakers from the closed loop bandwidth of the seat suspension system controller 24, so that interference is avoided.

Figure 2A:
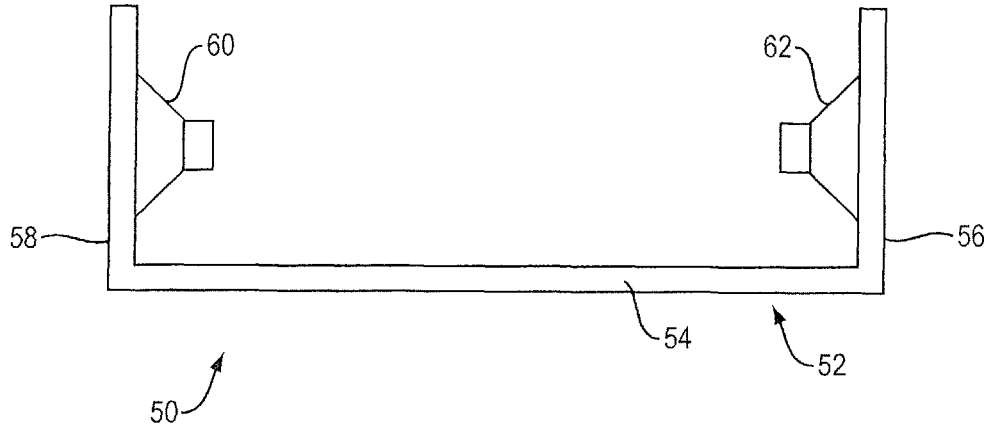
FIGS. 2A and 2B are side and top views, respectively, of a bass box that can be used in a suspended seat with bass loudspeakers.
Figure 2B:
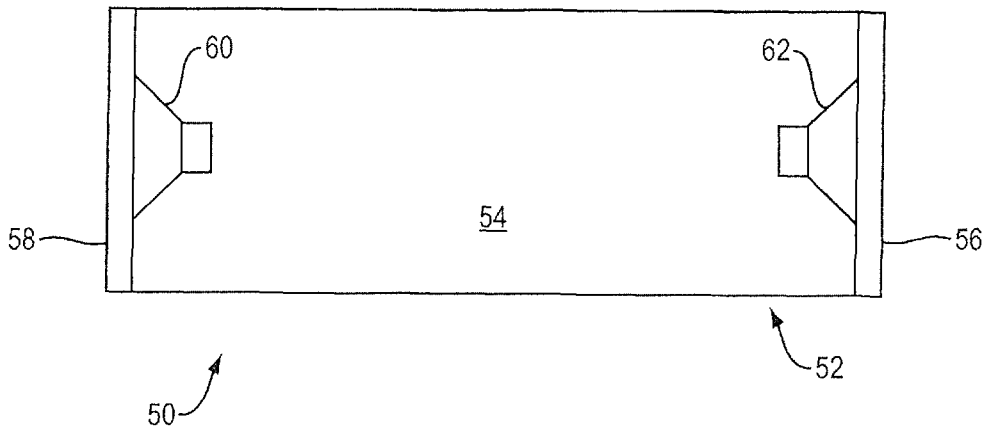

FIGS. 2A and 2B show one non-limiting example of a bass box 50 that can be used herein. Bass box 50 includes bass loudspeakers 60 and 62 which are mounted in opposition, as shown. If the speakers are operated at the same frequency and electrically/acoustically in phase, vibrations from the speakers destructively interfere with each other and are cancelled (presuming the speakers are identically constructed). Speakers 60 and 62 are also mounted to stiff metal plates 56 and 58, which are themselves mounted to (or integral with) stiff metal base plate 54. The stiffness of bass box 50 inhibits resonances that are within the typical closed loop operating range of the vibration control system 20, which is typically but not necessarily from about 1 Hz to about 15 Hz; the control system operating range could extend to 20 Hz or 30 Hz or higher, depending on design considerations. This disclosure is not limited to any particular vibration control system operating range. Bass box 50 thus preferably inhibits vibrations that can affect operation of vibration control system 20. Note that there are other manners to arrange and construct a bass box such that its output vibrations are decreased and any output vibrations are at frequencies above the typical range of an active vibration cancellation system; all such arrangements and constructions are within the scope of this disclosure.

Figure 3A:
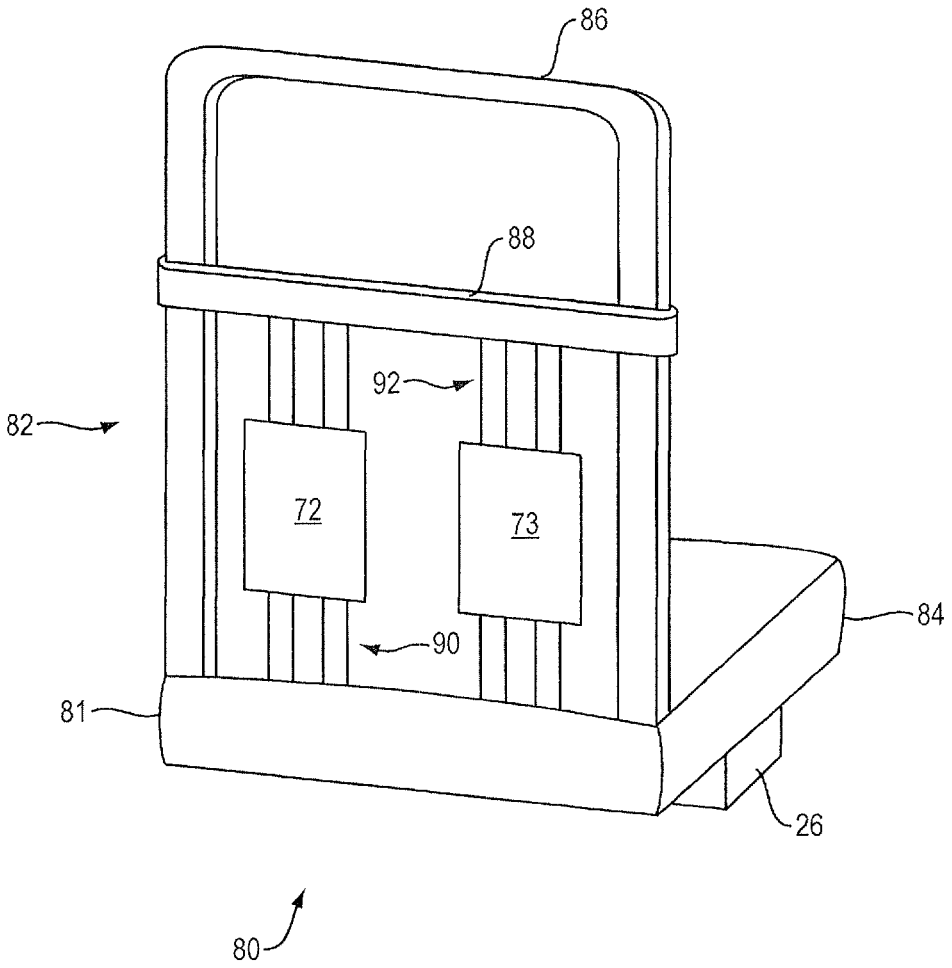
FIG. 3A is a partial rear view of a seat with two bass boxes mounted to it.
Figure 3B:
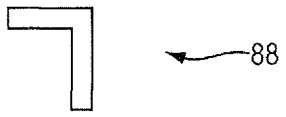
FIG. 3B is an end view of a stiffening rib of FIG. 3A.

FIG. 3A is a partial rear view of some of the structural portions of a motor vehicle seat 80 with two bass boxes 72 and 73 mounted to it. Seat 80 comprises seat base portion 84 (on which the driver or a passenger sits) and back portion 82. Cushions and other parts of the seat that are not pertinent to this disclosure are not shown. Back portion 82 has an outer structural frame 86, a mid height cross-member 88, and a lower cross-member 81. Cross member 88 is shown in end view in FIG. 3B.

At least one bass speaker is mounted on or in the seat. In this non-limiting example seat 80 includes four woofers, two each in each of bass boxes 72 and 73. Bass boxes 72 and 73 may be constructed and arranged like bass box 50, FIG. 2, or may be constructed and arranged in a different manner. There can be one, two, or more than two bass boxes. The woofer(s) can be mounted on or in the seat in different manners. Bass boxes are not required but are preferred. Ideally, any bass box used in this disclosure is constructed and arranged so as to reduce or cancel vibrations emanating from the speaker(s), before they can couple to the seat structure.

Bass boxes 72 and 73 are preferably coupled to the frame or structure 86 of seat 80. This coupling is schematically depicted via additional structural members 90 that couple each bass box to member 88 and lower cross member 81, which itself may be mechanically coupled to the seat base portion 84. Any or all of members 90, 88, 81 and 86 may be constructed and arranged so that vibrations from either of bass boxes 72 and 73 that are in the frequency range of the vibration control loop are minimized. This can be done by stiffening the seat structure to the point where its resonances are above the bandwidth of the vibration control loop. The use of the mid-back cross member 88, and its L-beam shape, add to the desired stiffening of seat structure 86. Accelerometer 26 of the vibration control system 20 is normally attached to the underneath of the seat base portion 84 so as to pick up accelerations pertinent to what the seat occupant would feel.

Stiffening the seat structure (e.g., by stiffening mid-height cross-member 88 and lower cross member 81) causes the resonances to move up in frequency, preferably beyond the bandwidth of the vibration control loop. This will reduce vibration signal levels seen by the accelerometer generated by the speaker in the frequency band of the controller. This keeps vibration signals from the audio system out of the controller. However, this does not necessarily keep from saturating the sensor, as there will still be amplification by the resonance of energy input to the seat system in the frequency range of the resonance. Resonances are thereby also reduced to the mechanically coupled seat base portion 84, and thereby resonances caused by the bass box and that are measurable by the accelerometer 26 of the vibration control system 20 are also reduced.

Figure 4:
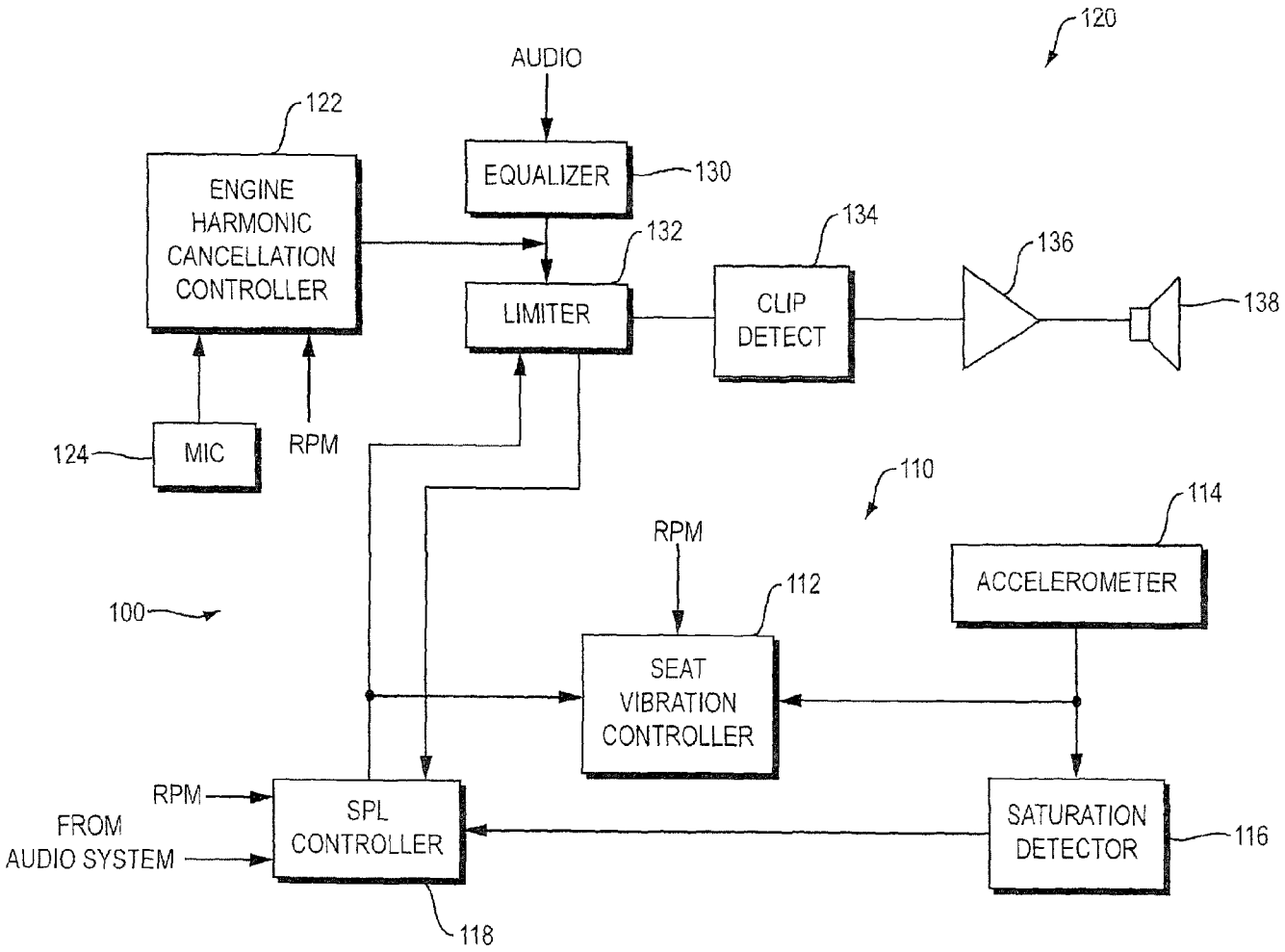
FIG. 4 is a schematic diagram of a suspended seat with bass loudspeakers and an engine harmonic cancellation (EHC) system.

FIG. 4 is a schematic diagram of the active members of a system 100 which includes one or more bass loudspeakers 138 that are mounted on or in a suspended seat. System 100 further includes engine harmonic cancellation (EHC) system 110. As described above, the operating bandwidth of the bass speakers 138 is preferably separated from the closed loop bandwidth of the seat suspension system controller 112, so that interference by the bass speakers with the seat vibration control is avoided. The bass loudspeakers used by the audio system may or may not be the same bass loudspeakers that are used by the EHC system.

Seat vibration control system 110 comprises seat vibration controller 112 and input sensor (accelerometer) 114, which function to control seat vibrations as described above. The functions of saturation detector 116 and sound pressure level (SPL) controller 118 will be explained below. Engine harmonic cancellation system 100 comprises EHC controller 122 that has cabin microphone(s) 124 as an input, along with amp 136 that drives output bass loudspeaker(s) 138. System 100 is also involved in cabin audio via equalizer 130 that is input with the audio signal. The functions of limiter 132 and clip detector 134 will be explained below.

System 100 can be operated so that the operating bandwidth of the bass speaker(s) 138 (both for cabin audio and EHC) is separated from the closed loop bandwidth of the seat suspension system controller 112, so that interference by the bass speakers with the seat vibration control is avoided. One manner in which this result can be accomplished is by determining the bandwidth of controller 112, and then operating controller 122 (and potentially as well, equalizer 130) such that the output band of speaker 138 is separated from (in this case, higher than) the control loop bandwidth of controller 112. This way, any vibrations sensed by accelerometer 114 are not caused by speaker 138, and so neither the audio system nor the EHC system interfere with seat vibration control.

System 100 can also include dynamic control of the bass loudspeaker output frequency range. One non-limiting reason for such dynamic control is to allow the lower end of the EHC system output band to change, while still maintaining the desired bandwidth separation described above. For example, as engine RPM increases the engine harmonics that controller 122 is enabled to cancel will increase as well. Thus as RPM increases the corner frequency of the EHC output band can be increased, which further separates this band from the vibration control loop band. As one non-limiting illustration, at an idle speed of 600 RPM an engine third harmonic may be at about 30 Hz, while at an operating speed of 1000 RPM the third harmonic of the same engine might be around 50 Hz. If controller 122 is enabled to cancel third harmonic vibrations, it should ideally be enabled to cancel 30 Hz noise when the engine is idling, and can be altered so as to cancel 50 Hz noise when the engine is operating at 1000 RPM. Obviously, if other engine harmonics are to be cancelled, and other engine RPM ranges accommodated, the output range of the EHC system would ideally be established as needed. So, at higher RPMs the EHC system high-pass filter can have a higher corner frequency. Dynamic bandwidth control thus allows the lower end of the EHC bandwidth (and the bandwidth of the cabin audio when vibration control system 110 is coupled to and can control both the EHC system and the audio system) to be increased to a point where it does not overlap with the control frequency range of vibration control system 110. System 120 (e.g., via controller 122) can accommodate this variable operating frequency range in a desired manner, such as by having a sliding high-pass filter that is used to adjust the frequency range of the EHC system depending on the engine RPM received from the vehicle control system.

In system 100, seat vibration control system 110 is coupled to and can affect the operation of the motor vehicle cabin audio system. However, this is not a limitation of the disclosure as the EHC audio output and the sound reproduction (audio) system output function separately. For example, the audio system output does not vary in the same manner as a function of vehicle operation than does the EHC system output. The audio system may not be dynamic at all, or it may have dynamic processing. One non-limiting example of dynamic audio system operation involves automatically increasing audio volume when cabin noise increases. In cases where vibration control system 110 is coupled to and can control aspects of the vehicle sound reproduction (i.e., audio) system, the vibration control system should have audio system control priority over any other system that is able to increase cabin SPL. This is because vibration control can cause motion of the seat relative to the floor and thus involves vehicle safety and so should always take precedence over a sound system.

In some cases the bass speaker(s) may cause vibrations that are in the frequency range of the vibration control loop. Such vibrations may be detected by accelerometer 114 and lead to vibration control error. In such cases, it would be desirable to remove or attenuate the component of the output signal from the accelerometer 114 due to the output from the bass speaker. One method of attenuating the component due to the bass speaker operation is described below, where the amplitude of output signals from the bass speakers is controlled in some manner by the vibration control system 110. Alternatively, since the audio signal is known, it can be used as a reference input to an adaptive noise canceller, where the adaptive noise canceller is arranged to subtract a filtered version of the audio signal reference from the accelerometer output signal, and the response of the filter is adapted to minimize the component of the audio signal present in the accelerometer output. Adaptive noise cancellers are well known in the art (see "Adaptive Signal Processing", by Bernard Widrow and Samuel D. Stearns).

Also, in some cases vibrations from the bass speakers can saturate accelerometer 114. If the accelerometer saturates, it no longer provides a useful signal for controller 112 and seat vibration control would cease to operate as designed. System 100 can be enabled to determine if the accelerometer is saturated and, if so, alter operation of the EHC system and/or the audio system in an attempt to operate such system(s) in a manner such that the accelerometer no longer saturates. Accelerometer saturation can in this one non-limiting example be determined via saturation detector 116. The vibration control system is able to cause a change in one or both of the EHC system and the audio system. Thus, for example if the accelerometer saturation is due to the audio system, SPL controller 118 can cause limiter 132 to limit the audio volume of loudspeaker 138.

System 100 can be enabled to determine if saturation is caused by the audio system in one or more manners. One manner is to input SPL controller 118 with a signal from the audio system that is indicative of the audio being played at a high volume, e. g., via the volume control signal. Cabin SPL controller 118 can be enabled to conclude that accelerometer saturation is due to the audio system when the volume control is at or above a level, such as 90%. Another example is that the output of a clip detector 134 could also indicate that the audio system is playing at high volumes and this signal could be fed to SPL controller 118. The purpose of the clip detector is to indicate when the signal being applied to the amplifier 136 and loudspeaker(s) 138 is above a certain threshold that signifies a high output listening level. Loudspeaker(s) 138 could be part of the bass box integrated into the seat as described previously. Or, the bass loudspeaker(s) themselves, or the bass box(es) when present, can be in a location other than the seat, e.g., a door panel. It is possible that the bass loudspeaker output can couple to the accelerometer regardless of the locations of the speakers (i.e., whether or not the speakers are mounted on or in the seat, or elsewhere in the motor vehicle). If accelerometer saturation is determined to have been caused by cabin loudspeakers, controller 118 can decrease the loudspeaker output. One non-limiting manner in which this can be done is to cause limiter 132 to limit the audio volume of loudspeaker(s) 138.

Another manner that system 100 can be enabled to determine if saturation is caused by the audio system is for controller 112 to self-diagnose whether a saturated accelerometer is likely due to the motor vehicle driving conditions or not (in which case it is likely due to the audio system). For example, if the engine is idling, or the speedometer is at 0 mph, or the gear is set to neutral, and the audio system is on and the volume is set high, then it is likely that accelerometer saturation is caused by the audio system and not the engine or road conditions.

If the accelerometer is saturated the seat vibration control system will likely not operate correctly. This is undesirable. System 100 can be enabled to take one or more actions meant to maintain at least some operation of the seat vibration control in the case when the accelerometer is saturated. If accelerometer saturation is caused by the audio system there are several possible actions that can be taken so that the seat vibration control system still operates. One action would be to turn the suspension into passive mode. In passive mode the electromagnetic actuator can be de-energized and clamped such that it acts as a passive damper rather than not operating at all. Another action would be to operate the vibration controller using an input sensor other than the accelerometer and that is not saturated, for example the position detector. The control law utilizing this other sensor is designed to achieve a desired result, fixed seat position being one of many possible such results. Also, it could be possible to double differentiate the position sensor output to estimate acceleration. Or, the vibration control system could have more than one accelerometer available to it, with different dynamic ranges. If the sensor with a smaller dynamic range and thus better resolution saturated, control could be switched so as to be based on the sensor with a greater dynamic range. In this case the two sensor signals could also be used as a saturation detector for the sensor with the smaller dynamic range. Another action that could be taken so that the seat vibration control system still operates when the accelerometer is saturated would be to reduce the audio volume, as described above. Volume reduction could proceed in one or more steps until the saturation has been resolved and the vibration control system can begin to operate normally. Yet another action would be to modify the vibration control algorithm settings to make the system more rigid (stiffer) such that the seat more closely follows the motion of the floor than it does when vibration control is fully operational. Still another action would be to hold the seat in a fixed position using the position sensor as the input to the vibration control system 20. In this case the position sensor on the active element of the vibration control system is not sensitive or affected by resonances or vibrations.

Embodiments of the systems and methods described above comprise computer components and computer-implemented actions and steps that will be apparent to those skilled in the art. For example, it should be understood by one of skill in the art that the computer-implemented actions steps may be stored as computer-executable instructions on a computer-readable medium such as, for example, floppy disks, hard disks, optical disks, flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A system for outputting sound and controlling vibration in a motor vehicle comprising:

a cabin audio system configured for music reproduction that is able to generate sound in the cabin; and a seat active suspension system comprising a first vibration sensor coupled to the seat, an electromagnetic actuator for outputting force to the seat, and; a vibration control system that is responsive to the first vibration sensor and that outputs control signals that are provided to the electromagnetic actuator that reduces seat vibrations;

wherein the vibration control system is configured to cause a change in the cabin audio system.

2. The system of claim 1 wherein the change in the cabin audio system caused by the vibration control system takes priority over other dynamic changes to the cabin audio system that are part of the cabin audio system function.

3. The system of claim 1 further comprising an engine harmonic cancellation (EHC) system that uses a bass loudspeaker to decrease cabin sound pressure level caused by engine harmonic vibrations.

4. The system of claim 3 wherein the EHC system comprises a high pass filter to control the output bandwidth of the EHC system, wherein a corner frequency of the high pass filter is varied as a function of the operating engine RPM of the motor vehicle.

5. The system of claim 1 wherein the cabin audio system further comprises a bass loudspeaker.

6. The system of claim 5 wherein the bass loudspeaker is attached to the seat.

7. The system of claim 6 wherein the bass loudspeaker is compliantly attached to the seat.

8. The system of claim 6 wherein the bass loudspeaker comprises a pair of bass loudspeaker elements mounted in opposition such that vibrations from the pair of bass loudspeaker elements destructively interfere with each other.

9. The system of claim 5 wherein a mechanical filter is inserted in the structural path between the bass loudspeaker and the first vibration sensor such that vibration from the bass loudspeaker that reaches the first vibration sensor is attenuated.

10. The system of claim 1 wherein a structure of the seat is stiffened such that resonances of the seat structure occurs higher in frequency than an operating bandwidth of the active suspension system.

11. The system of claim 1 wherein the change caused in the cabin audio system comprises a reduction in the output level of the cabin audio system.

12. The system of claim 11 wherein the change caused in the cabin audio system further comprises a change in the operating bandwidth of the cabin audio system.

13. The system of claim 1 wherein the change caused in the cabin audio system comprises a change in an operating bandwidth of the cabin audio system.

14. The system of claim 1 wherein the seat vibration control system further comprises a saturation detector to detect saturation of the first vibration sensor.

15. The system of claim 14 wherein the seat vibration control system causes a change in the cabin audio system when saturation of the first vibration sensor is detected by the saturation detector.

16. The system of claim 14 wherein the seat vibration control system is caused to operate in a passive mode when saturation of the first vibration sensor by the cabin audio system output is detected by the saturation detector.

17. The system of claim 14 wherein the active suspension system is caused to operate using the output of a second vibration sensor that is not saturated, when saturation of the first vibration sensor by the cabin audio system output is detected by the saturation detector.

18. The system of claim 17 wherein the first vibration sensor is an accelerometer and the second vibration sensor is a position sensor.

19. A system for a seat in a motor vehicle that has a cabin audio system and a bass loudspeaker that is able to generate sound in the cabin, the system comprising:

a seat active suspension system comprising a vibration sensor coupled to the seat and a controller that is responsive to the vibration sensor and that outputs control signals that are provided to an electromagnetic actuator that reduces seat vibrations;

wherein the active suspension system has a control loop bandwidth and the audio system has an operating frequency range that is constrained to be above the control loop bandwidth.

20. A system for a seat in a motor vehicle that has a cabin audio system and a bass loudspeaker that is able to generate sound in the cabin, the system comprising:

a seat active suspension system comprising a vibration sensor coupled to the seat and a vibration control system that is responsive to the vibration sensor and that outputs control signals that are provided to an electromagnetic actuator that reduces seat vibrations; and an adaptive noise canceller;

wherein the adaptive noise canceller is arranged to subtract an adaptively filtered version of a signal being reproduced by the cabin audio system from the vibration sensor output, to reduce the component of the vibration sensor output related to the audio system output.

* * * * *